United States Patent [19]

Lee

[11] 4,438,590

[45] Mar. 27, 1984

[54] ELECTRIC MOTOR TOY CAR

[75] Inventor: Cheuk-Ming Lee, Hong Kong, Hong Kong

[73] Assignee: The Refined Industry Company, Limited, Kowloon, Hong Kong

[21] Appl. No.: 421,550

[22] Filed: Sep. 22, 1982

[30] Foreign Application Priority Data

Nov. 11, 1981 [GB] United Kingdom ..... 8133986

[51] Int. Cl.[3] ..... A63H 17/00

[52] U.S. Cl. ..... 46/257

[58] Field of Search ..... 46/251, 252, 253, 254, 46/256, 257-262; 104/60, 305, 304; 273/86 B

[56] References Cited

U.S. PATENT DOCUMENTS

| | | | |
|---|---|---|---|
| 3,583,097 | 6/1971 | Richter | 46/257 |
| 4,031,661 | 6/1977 | Bernhard | 46/259 |
| 4,295,295 | 10/1981 | Brand et al. | 46/259 |

*Primary Examiner*—Mickey Yu

*Attorney, Agent, or Firm*—Townsend and Townsend

[57] ABSTRACT

This invention relates to a toy car which having a chassis, a motor arranged to drive a set of wheels, a terminal strip arranged to pick up current from a wire embedded in a track, the car additionally being provided with a wiper which is mounted to contact the terminal strip and to contact the motor whereby current passes from the track via the terminal strip and wiper to the motor. The car can be used in both slot racing systems and slotless racing systems.

2 Claims, 3 Drawing Figures

ELECTRIC MOTOR TOY CAR

The present invention relates to toy racing cars and in particular to a wiper plate for such a car.

BACKGROUND TO THE INVENTION

Toy racing car sets are known in which an endless track is provided and cars driven electrically are raced against one another around the track. There are two basic systems for achieving this. The first system is known as "slot racing" since a slot is provided in the track into which a pin on the underside of the car projects whereby the car is guided round the track in a particular lane. The second system is known as "slotless racing" in which each car does not have to move in a particular lane but can move from one lane to another. The present invention is particularly directed to cars for use in both the slot racing system and the slotless racing system.

Known toy racing cars for use with a slotted or slotless track do not necessarily have good electrical contact between the motor and the terminal strip on the cars which picks up the current from the track to drive the car motor.

The invention has been made with this point in mind and it is an object of the present invention to reduce or overcome such problem.

BRIEF SUMMARY OF THE INVENTION

According to the invention there is provided a toy car for use with a slotted or slotless track; said toy car comprising: a chassis, a motor for driving a set of wheels, a terminal strip for picking up current from a wire in said track, a wiper mounted to contact said terminal strip and to contact said motor so that current passes from said track wire via said terminal strip and said wiper to said motor, said wiper comprising a thin metal plate, one end of said wiper is bent at an angle of approximately 90° to the body of said plate, said bent end portion defining a cut-out portion to receive one end of said terminal strip and a tail projecting from the angle for contacting an electric brush of said motor and a lug bent at approximately 90° to the body of said plate on the other end of said plate to engage a projection on said chassis, so that said wiper is held in a position on said chassis. This end of the plate may also be provided, if desired, with one or two flanges to act as electrical terminals for the car head-lights.

A spring is preferably provided which biases the terminal strip into contact with the track wire.

One or more L-shaped iron strips may be mounted on the chassis to conduct the magnetic force of the motor. Thus when the car is on the track the magnetic force of the motor is passed to the iron strip which is then attracted to the track wire. This lowers the centre of gravity of the car and prevents it from overturning at high speeds.

Electrical current reaches the car motor from the track wire by means of the terminal strip and the wiper. The current turns the motor on its shaft in a counter clockwise direction. As a result a pinion on the end of the motor shaft also turns in the same direction, rotating a crown gear mounted on the rear axle thereby rotating the rear axle and the rear wheels mounted at either end of the axle—thus propelling the car forward.

BRIEF DESCRIPTION OF THE DRAWINGS

The invention will now be described, by way of example, with reference to the accompanying drawings, in which.

DESCRIPTION OF THE PREFERRED EMBODIMENTS

Figure 1:
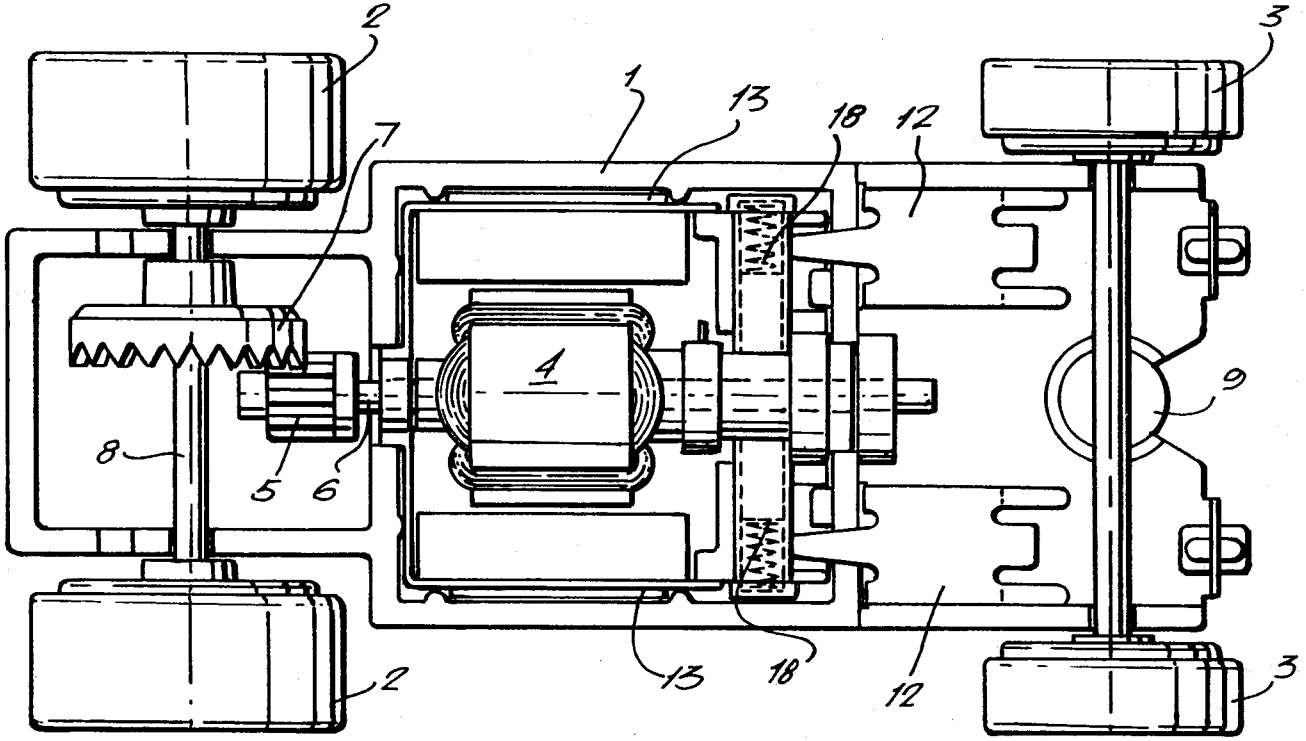
FIG. 1 is a plan view of an embodiment of the present invention.

FIG. 1 shows a plan view of a car in accordance with the present invention which includes a chassis 1, rear wheels 2, front wheels 3 and motor 4. The motor 4 drives the rear wheels 2 through a pinion 5 on the end of motor shaft 6 which meshes with a crown gear 7 which is mounted on rear axle 8, to the two ends of which are mounted the rear wheels 2.

In use the car is placed on a track and a guide pin 9 locates in a slot in the track. The track is also provided with a continuous wire through which electricity passes. Terminal strips 10 (see FIG. 3) are forced into good contact with the wire in the track by springs 11. The current picked up from the track wire by the terminal strips 10 passes through wiper 12 to the motor 4. The current turns the motor 4 on its shaft in a counter clockwise direction. As a result the pinion 5 also turns in the same direction rotating the crown gear 7 which in turn rotates rear axle 8 and rear wheels 2 to propel the car forward.

Iron strips 13 are provided to pick up the magnetic force of the motor 4 and thereby create a magnetic attraction for the car onto the track wires which serves to lower the centre of gravity of the car and thereby prevent its overturning at high speed.

Figure 2:
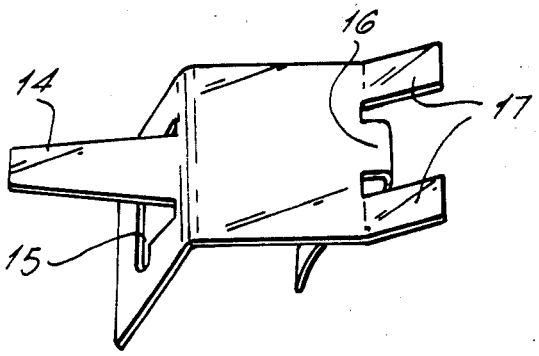
FIG. 2 is a perspective view of a wiper in accordance with the present invention.

FIG. 2 shows a particular form of wiper 12 which has a tail 14 arranged to contact a brush 18 (see FIG. 3) of motor 4, a cut out portion 15, through which terminal strip 10 is inserted (see FIG. 3), a lug 16 for fixing wiper 12 onto the chassis 1 and flanges 17 which act as electrical terminals for the car's headlights.

Figure 3:
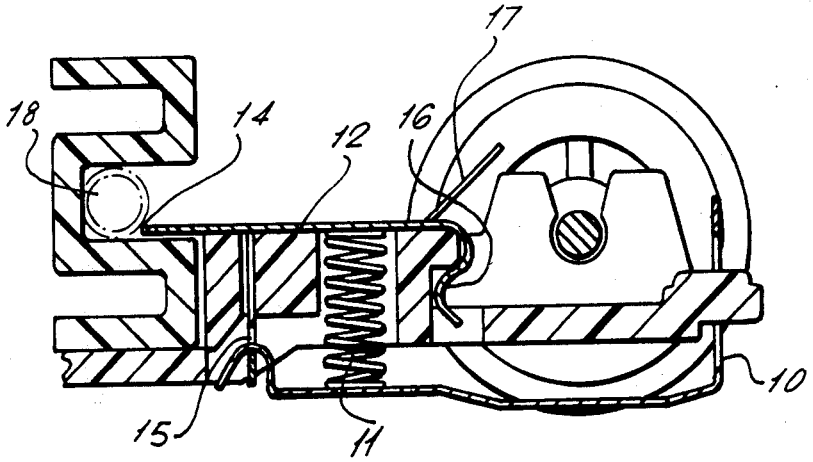
FIG. 3 is a section through the front of a car in accordance with the present invention.

FIG. 3 is a cross-section through the front of a toy car in accordance with the present invention which shows the wiper 12 in position and contacting the terminal strips 10 and the brush 18 of the motor 4. Spring 11 forces the terminal strip 10 into contact with the track wire.

I claim:

1. A toy car for use with a slotted or slotless track; said toy car comprising:

a chassis, a motor for driving a set of wheels, a terminal strip for picking up current from a wire in said track, a wiper mounted to contact said terminal strip and to contact said motor so that current passes from said track wire via said terminal strip and said wiper to said motor, said wiper comprising a thin metal plate, one end of said wiper is bent at an angle of approximately 90° to the body of said plate, said bent end portion defining a cut-out portion to receive one end of said terminal strip and a tail projecting from the angle for contacting an electric brush of said motor and a lug bent at approximately 90° to the body of said plate on the other end of said plate to engage a projection on said chassis, so that said wiper is held in position on said chassis.

2. A toy car according to claim 1, in which one or more flanges which act as electrical terminals for said car headlights are provided on the other end of said plate.

* * * * *